United States Patent [19]

Hechtel

[11] 4,096,409

[45] Jun. 20, 1978

[54] MULTISTAGE DEPRESSED COLLECTOR

[75] Inventor: Johann Richard Hechtel, Redwood City, Calif.

[73] Assignee: Litton Systems, Inc., San Carlos, Calif.

[21] Appl. No.: 729,488

[22] Filed: Oct. 4, 1976

[51] Int. Cl.[2] ..... H01J 23/02

[52] U.S. Cl. ..... 315/5.38; 315/3.5

[58] Field of Search ..... 315/5.38, 3.5, 3.6

[56] References Cited

U.S. PATENT DOCUMENTS

| | | | |
|---|---|---|---|
| 3,368,104 | 2/1968 | McCullough | 315/5.38 |
| 3,526,805 | 9/1970 | Okoshi et al. | 315/5.38 |
| 3,644,778 | 2/1972 | Mihran et al. | 315/5.38 |
| 3,702,951 | 11/1972 | Kosmahl | 315/5.38 |
| 3,764,850 | 10/1973 | Kosmahl | 315/5.38 |
| 3,940,655 | 2/1976 | Palluel et al. | 315/5.38 |
| 3,993,925 | 11/1976 | Achter et al. | 315/5.38 |

*Primary Examiner*—Saxfield Chatmon, Jr.
*Attorney, Agent, or Firm*—Ronald M. Goldman

[57] ABSTRACT

A multistage depressed collector for collecting spent electrons from an electron beam useful as an element of a microwave tube includes an evacuated region having an entrance at one end for receiving electrons, and means for establishing an essentially two-dimensional hyperbolic electrostatic focusing field within the evacuated region defined by equipotential field lines having the geometry of concave curves as viewed from said electron entrance, and a plurality of electrodes located along equipotential lines, and wherein said entrance is located asymmetrically with respect to the electrodes. The foregoing structure includes a final electrode, a plurality of intermediate electrodes, each of the intermediate electrodes having an electron beam passage therethrough, and all of said electrodes having an essentially concave geometry, as viewed from said entrance.

15 Claims, 6 Drawing Figures

MULTISTAGE DEPRESSED COLLECTOR

BACKGROUND OF THE INVENTION

This invention relates to a collector and, more particularly, to a multistage depressed collector of improved efficiency used to collect moving electrons. Many electronic devices employ a traveling stream of charged particles, such as electrons, formed into a beam as an essential function in the device's operation. For example, one type of microwave tube, the traveling wave tube, incorporates a source of electrons that are formed into a beam, in which the electrons are accelerated to a predetermined velocity and directed along an axial path through an "interaction" region within the microwave tube body. In the interaction region, kinetic energy is transferred from the moving electrons to the high frequency electromagnetic fields, such as microwave signals, that are propagating along a slow wave structure through the interaction region at about the same velocity as the moving electrons. The electrons give up energy to the microwave field through the exchange process characterized as electronic interaction, evidenced by a lower velocity of the electrons exiting from the interaction region. The "spent" electrons pass out the interaction region where they are incident upon and collected by a final tube element, termed the collector. The collector collects and returns the incident electrons to the voltage source. As is recognized, much of the energy in a moving particle is released in the form of heat when the particle strikes a stationary element, such as the collector. This produces undesired heating in the microwave tube and a lower overall electrical efficiency of microwave tube operation.

The depressed collector as is known and, more particularly, the multistage depressed collector is a collector that increases the electrical efficiency of traveling wave tube operation as well as reduces undesirable heat generation by a process of velocity sorting of the electrons controlled by a retarding electric field. The field slows the electrons so that the electrons are collected by the electrodes at a reduced velocity and ideally at a zero velocity. As is known to those skilled in the art, the multistage depressed collector is characterized physically by a series of spaced metal electrodes, each containing a passage therethrough, a final electrode and a passage entry for receiving electrons. The electrodes are maintained at successively lower voltages with respect to the tube circuit taken as ground (or at successively higher negative voltages as otherwise viewed) so as to present a retarding electric field to the electrons which pass through the entrance into the collector region. Such types of devices are substantially well developed and hence are complex in nature as is known to the reader skilled in the art.

As far as known from the literature, the two most efficient structures in multistage depressed collectors prior to this invention are the so-called Japanese collector and the NASA-GE collector. By way of background, the reader may make reference to the following patents: U.S. Pat. No. 3,526,805 to Okoshi et al; U.S. Pat. No. 3,644,778 to Mihran et al; and U.S. Pat. No. 3,702,951 to Kosmahl, and to the following publications: *IEEE Transactions on Electron Devices,* Vol. ED-19, No. 1, Jan. 1972, pp 104—110; *The Titled Electric Field Soft Landing Collector and Its Application to a Traveling Wave Tube,* Okoshi et al; *IEEE Transactions on Electron Devices,* Vol. ED-19, No. 1, Jan. 1972, pp 111–121; *A Ten-Stage Electrostatic Depressed Collector for Improving Klystron Efficiency,* Neugebauer et al; and *Multistage Depressed Collector Investigation for Traveling Wave Tubes,* Tammaru, NASA CR-72950 EDDW-3207, Contract NAS 3-11536 Final Contract Report, should the reader desire to become acquainted with the structure of the foregoing in somewhat greater detail than is here presented.

The Japanese collector employs a combination of transverse electric field and a longitudinal magnetic field for sorting electrons as a function of the electron velocity. The NASA collector employs a retarding electric field established by a cuplike electrode and a pointed spike located in the center of the cuplike member. The effect of such structure with a voltage applied is to present an electron mirror with a negative focal length to electrons moving near the axis. Hence the reflected beam is more divergent than the incident beam. The efficiency of the aforementioned NASA collector is limited by the defocusing properties of the spikelike reflector element. In addition, some electrons may strike the spikelike element which, in turn, generates secondary electron emission and these secondary electrons may be accelerated back into the interaction region of the tube to cause difficulty. The Japanese collector as was noted, requires the maintenance of an axial magnetic field of a critical magnitude for proper functioning. As a result, the collector is not suited for high power operation.

OBJECTS OF THE INVENTION

It is accordingly an object of my invention to provide a structure in a multistage depressed collector of improved efficiency.

It is a further object of the invention to provide a novel multistage depressed collector which in operation substantially avoids the generation of secondary electrons and does not require the use of critical magnetic field focusing.

SUMMARY OF THE INVENTION

The novel collector is characterized by an evacuated region having an electron entrance, preferably of circular shape, asymmetrically located in the region and means for establishing an electrostatic focusing field essentially of a two-dimensional hyperbolic shape within the region, the electrostatic field having equipotential lines that define essentially concave curves as viewed from the said entrance, such means including: a rear reflector electrode located remote from said entrance and a plurality of intermediate electrodes, electrically insulated from and spaced from one another, intermediate said rear electrode and said entrance; each of said intermediate electrodes further having an electron beam passage therethrough, at least one of which is of a slotlike geometry therethrough; and each of said electrodes having an essentially concave geometry as viewed from said entrance; and said electron entrance being located asymmetrically with respect to said electrodes.

The foregoing and other objects of my invention as well as the structure characteristic of same and equivalents or substitutions for the elements thereof become more apparent to the reader from a study of the detailed description of the preferred embodiments of the invention, which follows, considered together with the illustrations presented in the accompanying drawings.

DESCRIPTION OF THE PREFERRED EMBODIMENTS

Figure 1:
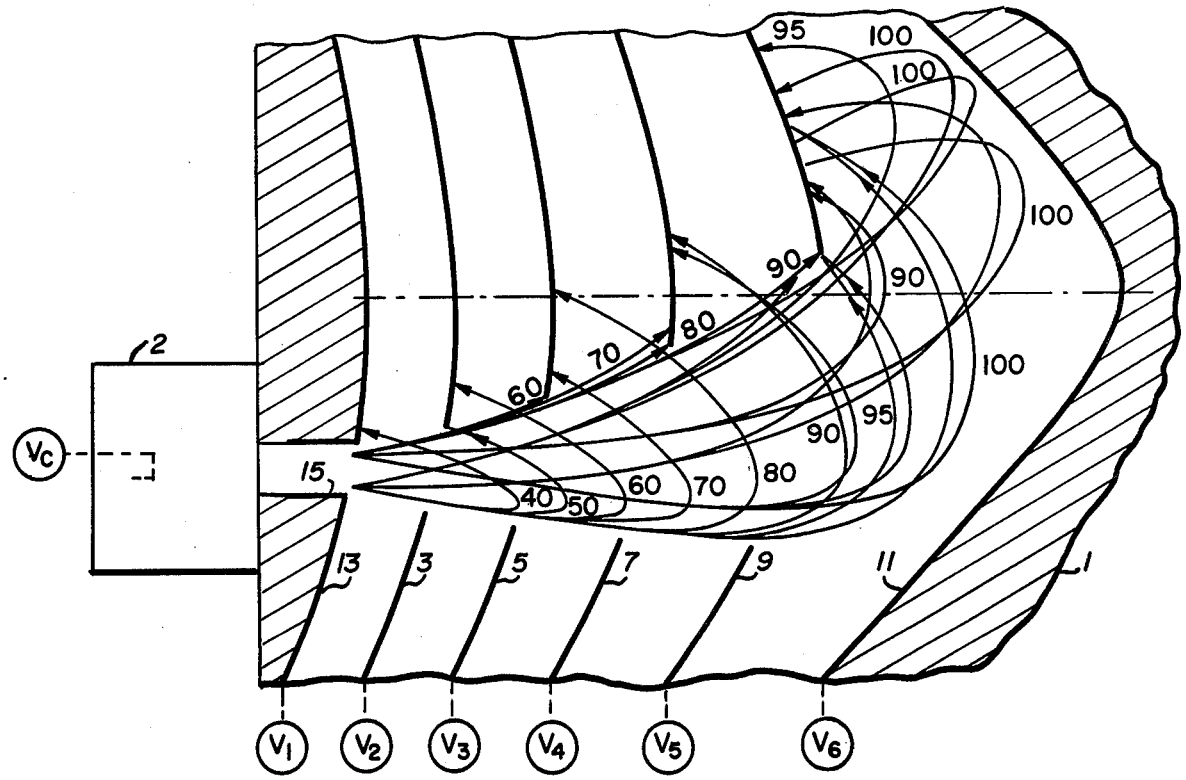
FIG. 1 is a partial schematic section view of a novel depressed collector.

A collector that embodies my invention is presented in the partial cross-section view of FIG. 1 and represents an idealized configuration. The collector 1 is shown connected as one element of a microwave tube 2, suitably a linear beam type, symbolically illustrated. Inasmuch as the detailed structure of the elements of the microwave tube are not necessary or essential to an understanding of the invention and are well known to those skilled in the art, the tube portion may be simply represented as illustrated and need not be further described. Further the relative dimensions of the collector in respect to the other main body of the microwave tube is exaggerated and not to scale, as is understood by those skilled in the art. The collector of this embodiment is referred to as a five-stage depressed collector in that it includes five spaced metal electrodes, including electrodes 3, 5, 7, 9 and 11. A metal wall 13, which can be considered as an end wall of the tube body or, alternatively, a front wall of the collector, includes an entrance 15 of circular cross-section, through which an electron beam originating within tube body 2 may enter the evacuated region defined by the collector walls, not all of which are illustrated. As is illustrated, each of the electrodes and entry wall 13 possess a two-dimensional geometric shape of a hyperbola. Each of electrodes 3, 5, 7 and 9 contain an opening of essentially a slotlike geometry located along the axis of entry 15. This opening is smallest in the first electrode 3 and progresses in width in subsequent electrodes to the maximum sized opening in the final electrode 9. The final electrode 11, sometimes referred to as the reflector electrode, does not contain an opening for passage electrons. The electrodes are spaced apart and are electrically insulated from one another by vacuum tight ceramic material, not illustrated. In the third dimension the electrodes are straight. Hence a cross-section of the collector taken along the beam axis, the axis of entrance 15, and in a plane orthogonal to the figure of the drawing would show a series of spaced straight lines. The collector is formed so as to be vacuum tight and the entire volume or region containing the collector electrodes is in-vacuum. Various DC voltages from a suitable power supply voltage source or sources are applied to the electrodes. By way of specific example, entry wall 13 is at a relative voltage of 100, electrode 3, 80 volts; electrodes 5, 60 volts; electrode 7, 40 volts; electrode 9 at 20 volts; the end wall 11 is at zero volts. These voltages are given with respect to the voltaage of the cathode in the microwave tube 2. Further considering an electron beam entering through 15 at a beam spread, $\Delta\alpha$, of 20° and an energy range covering between 40 and 100 electron volts, the trajectories of the electrons are as depicted in the figure as determined by a computer run evaluation of the collector action.

Considering the hyperbola formed by the end wall 11, an apex appears in the geometry which is located off the axis of the electron beam entrance 15 or, a otherwise termed, the entrance is located asymmetrically in the collector. As is evident from the hypothetical example in the operation of this collector, most of the electrons are seen to reverse in direction and are incident upon the back side of one or the other of the electrodes. Ideally, none of the electrons are incident upon the final electrode 11, which acts as a reflector. Some of the electrons, however, do strike the front surface of the electrodes.

In operation, electrons entering through entrance 15 are sorted according to their initial energy and collected in a two-dimensional retarding electrostatic field in which the magnitude of the field decreases in the direction of the original electron flow. Such an electrostatic field may be represented by a series of equipotential lines through familiar electrostatic mapping techniques to reveal a series of concave curves as viewed from the entrance 15. The voltages in the field, as becomes apparent, is decreasing along the axis of the collector from the entrance wall 13 to the final reflector electrode 11 and the second derivative of the voltage taken along the $y$ axis, $d^2V/dy^2$, is positive characterizing a "focusing" type electrostatic field. More particularly, the geometry of the electrostatic field is essentially that of a hyperbola which may be described by the equation $V = V_B (y^2-x^2-C_1^2) / (C_2^2-C_1^2)$, where $V_B$ is the voltage of the tube body 13 with respect to cathode potential, V is an arbitrary voltage, between $V=O$ (cathode potential) and $V=V_B$, and the factors $C_1$ and $C_2$ are constants describing the physical dimensions of the collector. As is depicted in the figure, ech of the electrodes 3 through 9 defines and is situated along an equipotential line. Ideally the geometry of the rear electrode may be defined by the mathematical expression $y^2-x^2-C_1^2=0$ and the surface of the tube body facing the collector may be described by the expression $y^2-x^2-C_2^2=0$. The distance between the apex of the rear reflector electrode and the apex of the tube body is given by $C_2-C_1$. The electron beam emerging through the entry passage enters the collector at some finite distance $d$ from the $x$ axis, for which $y=0$, by way of example, $d=0.2$ multiplied by the quantity $(C_2-C_1)$ and enters by a small but finite angle, $\alpha$, such as 5° with respect to the $y$ axis.

Figure 2:
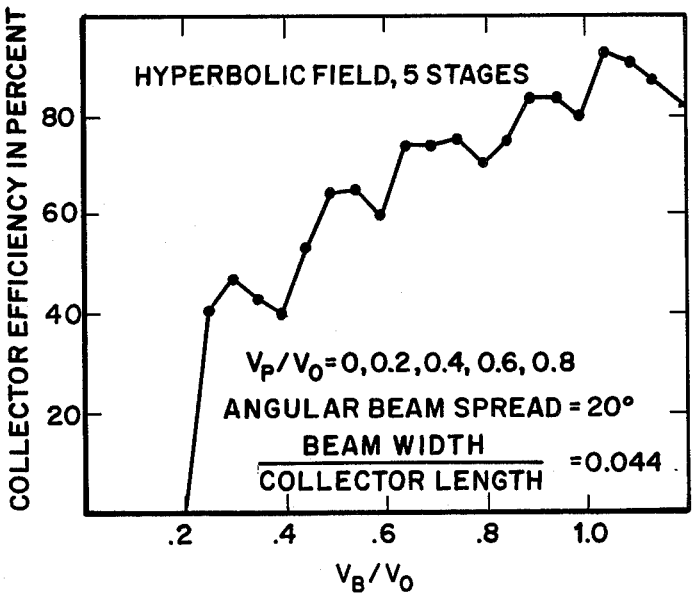
FIG. 2 is a graph which shows collector efficiency of the embodiment of FIG. 1 as theoretically determined from a computer analysis.

FIG. 2 depicts the efficiency expressed in percent as predicted by a computer program for the idealized five-stage depressed collector of FIG. 1, as a function of initial beam energy $V_B$ normalized to $V_o$. As observed from this prediction, very high efficiency is obtainable where the beam energy is greatest.

As is apparent to the reader, the fabrication of the collector elements to the precise hyperbolic shape as presented in FIG. 1 is difficult.

Figure 3:
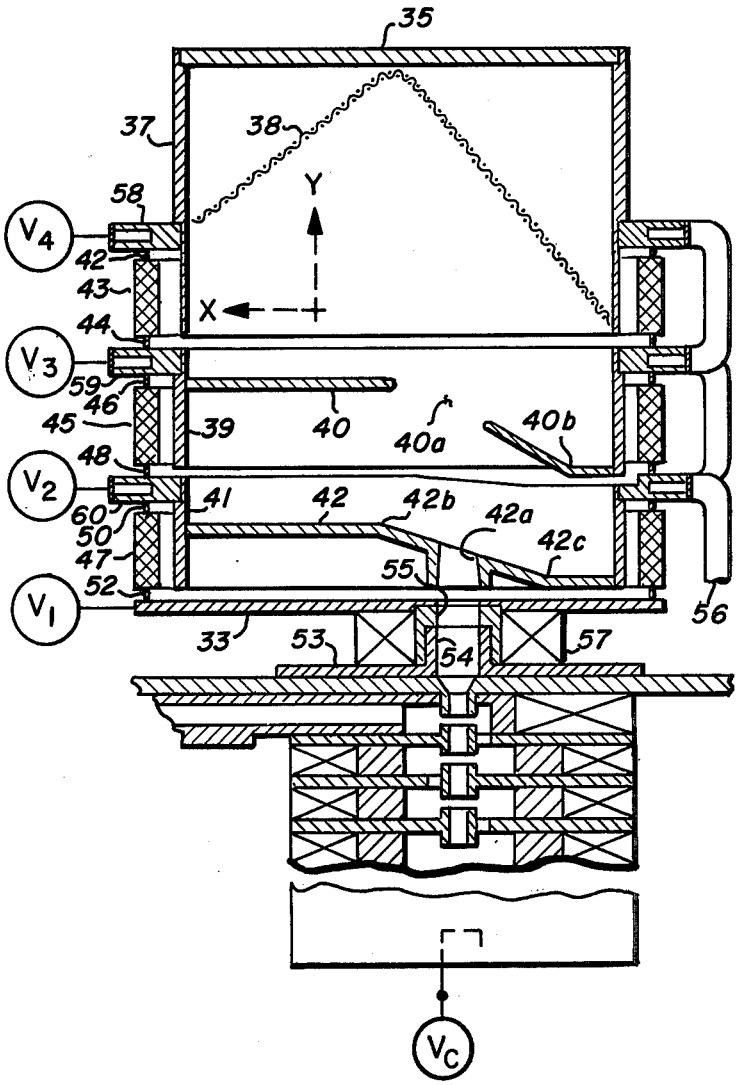
FIG. 3 is a section view of a practical embodiment of the invention.

Another embodiment of a collector, according to the invention, is presented in the cross-section view of FIG. 3. This embodiment is more practical in that it is the simplest to manufacture. The collector includes a iron front wall 33, a copper metal rear wall 35, a metal copper side wall 37, metal copper wall members 39 and 41, collector electrodes 40 and 42, respectively, suitably of copper, electrically insulative ceramic members 43, 45, 47 which are cylindrical in shape. Member 43 is brazed at each end to metal rims 42 and 44 and these metal rims, in turn, are brazed to an extension from side wall 37 and to an extension from wall 39 to form a vacuum tight connection. Similarly, ceramic member 45 is brazed in between metal members 46 and 48 which fastens member 45 to an extension from wall 39 and to an extension from wall 41. And lastly, ceramic member 47 is joined to an extension from wall 41 and to the front wall 33 by members 50 and 52. Thus, each of the electrodes is spaced apart and maintained electrically insulated from one another within a vacuum tight region defined by the outer walls and the ceramic. The structure includes further surrounding cooling channels 58, 59 and 60 for applying coolant to extract heat generated in the collector plates 40 and 42 and plate 35, and conducted out through the walls. The end of the tube body is represented by element 53 containing a cylindrical passage 54. This passage is aligned with a corresponding passage in entry wall 33 and joined by a nonmagnetic coupling element 55. A magnet 57, suitably a ring-shaped magnet, is mounted about the outer surface of the coupling 55 in between the space between tube body 53 and entry wall 33. The magnet is to provide an axial field to provide some refocusing of the electron beam. The final electrode 38, termed the reflector, is essentially a two-dimensional concave configuration, more particularly, a hyperbola, and is constructed of molybdenum wire mesh or grid material, and the electrode is attached to the wall 37. The apex of the curve formed by electrode 38 is spaced from the axis of entrance 54 to place the two in an asymmetric relationship in accordance with the factors outlined previously in the preceding embodiment. Reflector electrode 38 is preferably formed of the wire mesh or grid material in order to trap any secondary electrons, which may be generated on the surfaces of elements 35 and 37 due to electron impingement, within the region behind reflector 38 as well as to permit many of those electrons of a sufficiently high energy level capable of reching the reflector, to pass through into the rear region. The electrode 40 includes a relatively straight section and a tapered section with a passage therebetween to allow passage of the electron beam. The cross-section of this electrode as shown approximates a concave curve, more particularly, a hyperbola. The tube body 53 and the entry wall 33 are of magnetic iron material. This forms a magnetic circuit for magnet 57.

Figure 4:
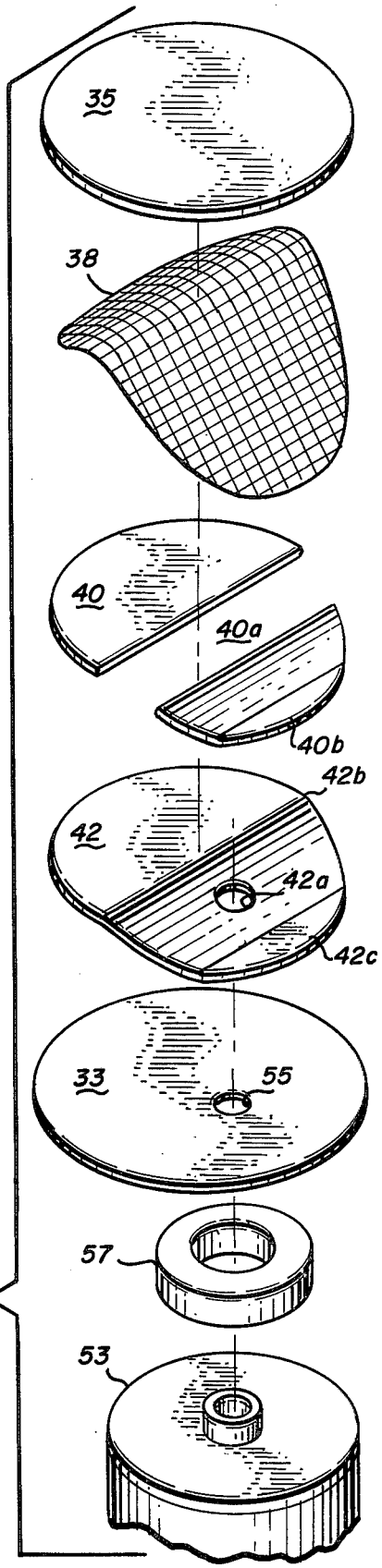
FIG. 4 is an exploded view of the electrodes used in the embodiment of FIG. 3.

Reference is made to the exploded view of the elements of the collector of FIG. 3, exclusive of the vacuum envelope parts presented in FIG. 4 where identical parts are identically labeled. As is shown, electrode 40 has a curved periphery so as to mate with the supporting cylindrical wall 39. And a slot-like opening **40*a* is therein formed for the electron passage. The straight bend 40*b*** is also shown.

The electrode 42 is the embodiment of FIG. 3 also approximates a hyperbola in the cross-section shape. Electrode 40 includes two straight sections joined by a straight tilted section which contains a passage for electrons. Again reference is made to the exploded view of FIG. 4 in which the electrode 42 of the embodiment of FIG. 3 is depicted. As is apparent, the peripheral surface is curved, and appears circular from the view, to mate with the inner surface of the cylindrical supporting wall 41 in FIG. 3. The electron passage **42*a* is a small essentially circular opening and the electrode is bent along the straight lines 42*b* and 42*c***.

The collector may be coupled at an end of a microwave tube, depicted as element 2 in FIG. 1. As in the preceding embodiment the spaced electrodes have applied suitable voltages $V_1$, $V_2$, $V_3$ and $V_4$ from any suitable source and these are decreasing in level in the order given taken with respect to the cathode voltage of the microwave tube section to define a hyperbolic focusing electrostatic field in the collector region; a field in which the second derivative of the voltage V, taken with respect to the *y* axis, which extends between the entrance wall and the reflector, is a positive number, with the equipotential lines in the region defining essentially a hyperbola of the same general mathematical relationship as represented in connection with the discussion of FIG. 1, but with different values for the constants, obviously; and with the spaced electrodes situated essentially along voltage equipotentials.

Ideally in operation, most electrons entering along the axis of entrance 54 travel in a curved path, are sorted electrostatically and strike the rear surfaces of either electrodes 42 or 40, suitably to the left side of the axis as viewed in FIG. 3. Some electrons of higher energy level may reach and strike reflector electrode 38 or pass through the mesh opening and strike the rear wall 35 or otherwise become trapped in the region between 38 and 35. Heat generated in the electrodes 40 and 42 is conducted through the walls 39 and 41, respectively, to the coolant, applied by a coolant source not illustrated, in channels 59 and 60.

One additional benefit resulting from the electron beam entering the collector asymmetrically or off-axis is that the danger of electrons reversing its travel and streaming bck into the tube to cause oscillation is greatly reduced, if not completely eliminated.

In a practical test of a collector according to FIG. 3, the collector was attached to a high power periodic permanent magnet focused dual mode coupled cavity type traveling wave tube, well known to those skilled in the art. It is noted that the magnetic lens 57 was included to serve a two-fold purpose: to prevent the electron beam from excessive spreading prior to entry into the collector region, and to reduce the transverse velocity spread in the electron beam. The voltages with respect to cathode applied to the electrodes were as follows:

$V_1 = V_o$;
$V_2 = 0.5\ V_o$;
$V_3 = 0.25\ V_o$; and
$V_4$ was at 0, where $V_o$ equals the potential difference between the cathode and tube body.

The tube and collector were tested under pulsed conditions at a duty cycle of 0.001 and a ratio between the beam diameter, W, to collector length, L, was taken at 0.044 and the results pertinent to those skilled in the art were obtained as follows:

TABLE I

| | TUBE OPERATING MODE | | |
|---|---|---|---|
| | High | Low | |
| Beam voltage, $V_o$ | 24.54 | 24.44 | k Volts |
| Beam current, $I_o$ | 3.43 | 0.831 | amps |
| Beam power, $V_oI_o$ | 84.17 | 20.31 | k Watts |
| Beam perveance | 0.892 | 0.217 | $\mu_{perv}$ |
| RF power output (peak) | 13.18 | 1.97 | kW |
| Frequency | 9.4 | 9.4 | GHz |
| Base tube efficiency, $\eta_o$ | 15.7 | 9.7 | percent |
| Collector voltages w.r.t. ground (body) | | | |
| Stage 1 | −12.0 | −12.0 | k Volts |

TABLE I-continued

| | TUBE OPERATING MODE | | |
|---|---|---|---|
| | High | Low | |
| Stage 2 | −18.0 | −18.0 | k Volts |
| Stage 3 | −24.0 | −24.5 | k Volts |
| Collector currents | | | |
| Stage 1 | 2.30 | 0.376 | amps |
| Stage 2 | .546 | .308 | amps |
| Stage 3 | .312 | .110 | amps |
| Stage 1 to 3 | 3.158 | .794 | amps |
| Beam transmission | 92.1 | 95.7 | percent |
| Power recovered in collector, $P_{rec}$ | 44.92 | 12.75 | k Watts |
| Net power input, $P_{net}$ | 39.25 | 7.56 | k Watts |
| Tube efficiency, $\eta_T$ | 33.6 | 26.1 | percent |
| RF circuit losses | 2.31 | 0.743 | k Watts |
| Circuit efficiency, $\eta_{ckt}$ | 0.85 | 0.73 | |
| Power due to beam interception ($\beta = 0.82$) | 5.47 | 0.74 | k Watts |
| Power entering collector | 63.21 | 16.86 | k Watts |
| Collector efficiency, $\eta_{coll}$ | 71.1 | 75.6 | percent |

Figure 5:
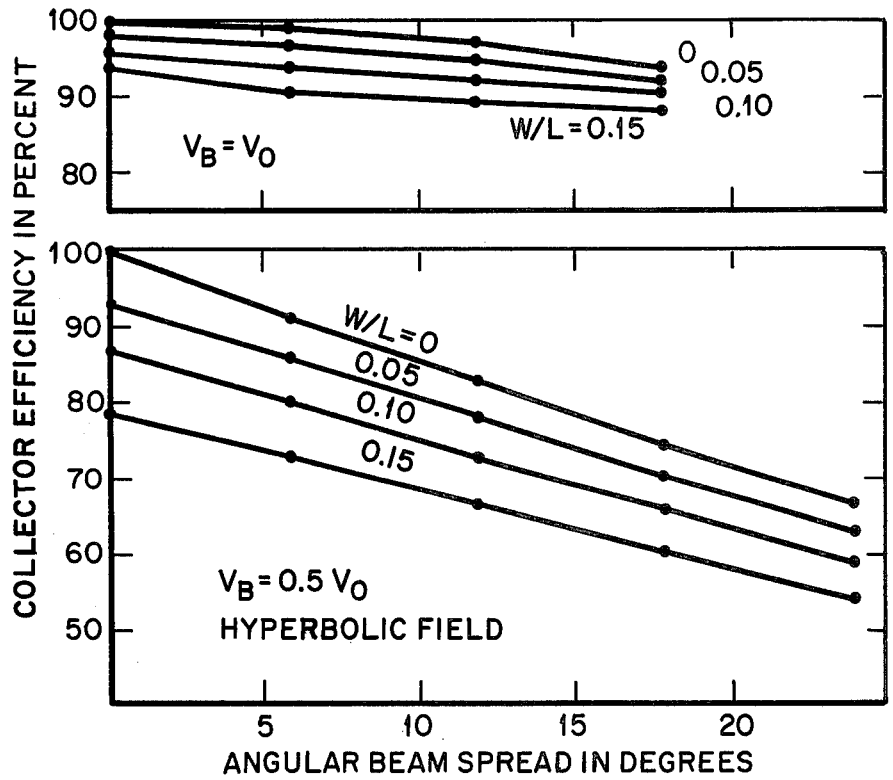
FIG. 5 is a graph illustrating collector efficiency as a function of beam spread.

It is noted the collector efficiency is a function of the ratio L/W, where W is the beam width and L is the length of the collector taken between the electron entrance and the final electrode. Thus, the greater the length of the collector, the greater the efficiency. Thus the change in efficiency as a function of angular beam spread, $\alpha$, for collectors with hyperbolic fields for differing ratios of W/L and for two different beam energy levels, $V_B$, is presented in FIG. 5.

Figure 6:
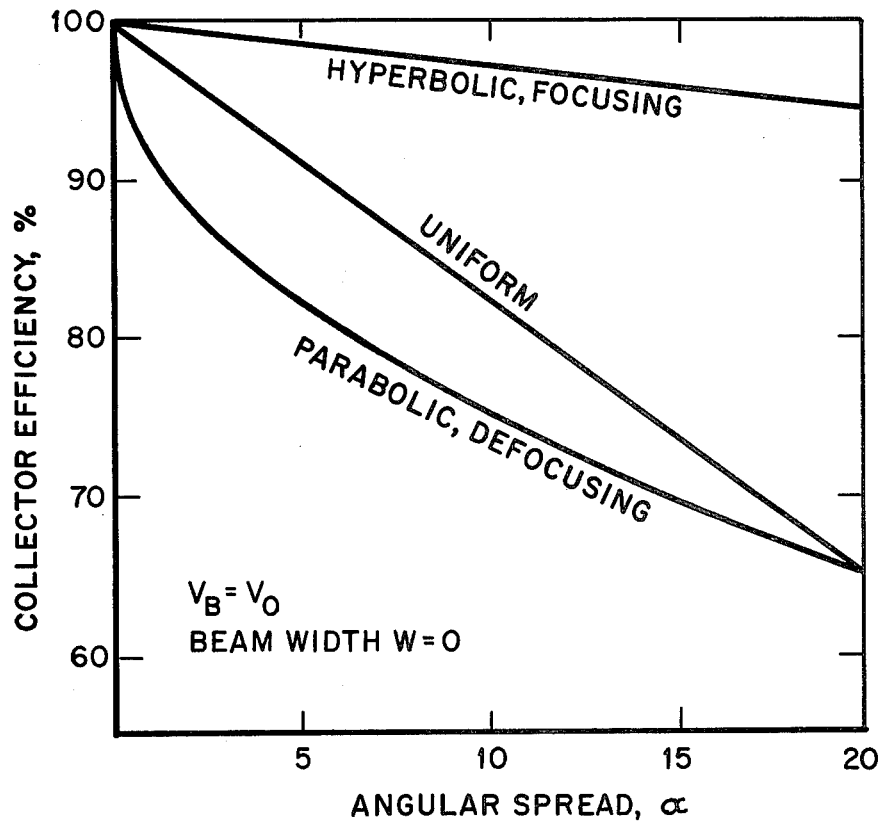
FIG. 6 is a graphical comparison of results with other collectors.

In relating my discovery further to prior art depressed collectors, the following conclusions were drawn: As a general result, I have found that under all conditions of beam energy, beam width and angular spread, collectors having fields with focusing properties gave higher collector efficiencies than those with fields having defocusing properties. And collectors with uniform retarding fields provide results between those obtained from the focusing type fields and the defocusing type fields, and that among the focusing fields the hyperbolic type field yields the highest collector efficiency which I have obtained. The relationship I have obtained is graphically depicted in FIG. 6 for the information of the reader.

It is believed that the foregoing description of the peferred embodiments of my invention are sufficient in detail to enable one skilled in the art to make and use same. However, it is expressly understood that the details presented for the foregoing purpose are not to be construed as limiting my invention inasmuch as various modifications or substitution of equivalent elements may be made, all of which become apparent to one skilled in the art upon reading this specification and which do not depart from the spirit and scope of my invention. Accordingly, it is respectfully requested that the invention presented be broadly construed within the full spirit and scope of the appended claims.

What I claim is:

1. In combination with an electron tube of the type containing an interaction region and means, including a cathode, for generating and directing electrons through said interaction region, a collector located beyond an end of said interaction region for collecting electrons, the improvement wherein said collector comprises: a metal wall containing a circular electron entrance for permitting electrons to enter, said entrance having an axis, a plurality of metal intermediate electrode members electrically insulated from and spaced from one another and from said wall along said entrance axis, and a final metal electrode member electrically insulated from and spaced from said metal members and wall; each of said intermediate members having passage openings along said entrance axis to permit electrons to move toward said final member; said final metal member having a surface concavely curved along two dimensions and extending straight along the third dimension as viewed from said entrance, said curved surface of said final metal member having an apex and said apex being laterally spaced from said entrance axis, wherein said entrance is located asymmetrically with respect to said final metal member; each of said intermediate electrodes being concavely curved along two dimensions as viewed from said beam entrance and extending essentially straight along the third dimension, and means for applying different voltages to each of said metal members and said wall, said voltages being progressively smaller in level with respect to the voltage of said tube cathode, commencing with said metal wall for defining concave-shaped electrostatic equipotentials as viewed from said beam entrance, whereby a substantial majority of electrons entering said collector through said entrance, are decelerated, and then reverse in direction of travel, and then strike the backside of at least one of said intermediate metal electrode members.

2. The invention as defined in claim 1 wherein said final member and each of said intermediate electrode members is of a hyperbolic cross-section shape in said two dimensions.

3. The invention as defined in claim 1 further comprising magnet means for producing an axial magnetic field along the axis of said entrance.

4. The invention as defined in claim 1 wherein said final electrode comprises a wire mesh material and further comprising a metal wall located behind said final electrode.

5. The invention as defined in claim 1 wherein at least one of said passages in an intermediate electrode is of a slot-like geometry.

6. A collector comprising:

an enclosed region, a metal wall member thereto containing a circular entrance having an axis for permitting electrons to enter said region;

a series of essentially two dimensional electrodes within said region, each containing a rectangular passage therethrough along said axis;

a final electrode; each of said electrodes being spaced from and electrically insulated from one another;

means for maintaining said metal wall member at a predetermined voltage, $V_B$ with respect to cathode;

means for applying a different consecutively smaller voltage with respect to cathode to each of said electrodes, said voltages and said electrodes cooperating to define an electrostatic field, V, essentially defined by the equation $V(x,y)=V_B(y^2-x^2-C_1^2)/(C_2^2-C_1^2)$; and $C_1$ and $C_2$ are constants.

7. The invention as defined in claim 6 wherein said final electrode has a surface geometry facing said entrance defined essentially by the equation:

$$y^2-x^2-C_2^2=0$$

and wherein the surface of the metal wall member facing said collector is defined essentially by the equation:

$$y^2-x^2-C_1^2=0$$

8. The invention as defined in claim 7 wherein said final electrode has an apex and wherein the surface of said metal wall is of a curvaceous shape defining an apex, and wherein the apex of the former is displaced laterally from said axis of said entrance to the apex of the latter by the distance $d = k\ (C_2 - C_1)$, where $k$ has a value in the vicinity of 0.2 times the length of the collector.

9. In combination with a microwave tube, the collector which comprises:

a bounded evacuated region;

a first metal electrode having a circular-like opening for permitting an electron beam to enter said evacuated region;

a plurality of intermediate spaced metal electrodes and a final metal electrode within said region, said electrodes defining an essentially two-dimensional geometric curve;

electron beam passages in intermediate ones of said electrodes; and means for applying distinct voltages to each of said electrodes for producing a focusing electrostatic field as viewed from said opening in said evacuated region characterized by the second derivative of the voltage with respect to the length of said collector, $d^2V/dy^2$, from said opening being a positive value; and wherein said circular opening is located asymmetrically with respect to said electrodes.

10. The invention as defined in claim 9 further including:

a ring magnet means for producing a magnetic field along the axis of said electron entrance.

11. The invention as defined in claim 9 wherein a final one of said electrodes comprises a wire mesh material.

12. An improved collector which comprises:

walls defining a chamber, said chamber extending a predetermined length along a first chamber axis in between a front and rear end;

an electron beam passage in the front end of said chamber; said passage being essentially of circular cross-section and having a passage axis, said passage axis being located off-set laterally from said chamber axis;

a plurality of electrodes located within said chamber, said electrodes being spaced from said electrically insulated from one another; each of said electrodes defining a relatively two-dimensional concave curve geometry as viewed from said electron beam passage; a final one of said plurality of electrodes located proximate said rear end of said chamber and having a curve apex, and said apex being located off-set laterally from said passage axis and being on or more proximate said chamber axis than to said passage axis, and the remaining ones of said electrodes being located intermediate said final electrode and said entry passage; each of said intermediate electrodes including an electron passage, with all of said passages overlying said electron beam passage; and wherein the width of said electron passage in a more rearwardly located one of said intermediate electrodes being greater than the width of the corresponding electron passage in an adjacent more forwardly located one of said intermediate electrodes.

13. The invention as defined in claim 12 wherein said final electrode comprises a wire mesh material.

14. An electron collector for a microwave tube having a tube body and a cathode maintained at a voltage of $-V_B$ with respect to tube body comprising:

an enclosed region, a metal wall member for said region, said wall member containing a circular entrance about an axis for permitting electrons to enter said region;

a series of essentially curved electrodes within said region, said electrodes defining a hyperbolic-like curve geometry in one plane and a straight line in a plane perpendicular to said one plane, each said electrode being oriented with its concave facing said circular entrance, each containing an electron passage therethrough located asymmetrically in said respective electrode, one or more of said passages being rectangular in shape;

a final electrode;

each of said electrodes being spaced from and electrically insulating from one another and adapted for connection to respect different voltages;

means for maintaining said metal wall member at a predetermined voltage, $V_B$, with respect to cathode;

means for applying a different consecutively smaller voltage with respect to cathode to each of said electrodes, whereby said voltages and said electrodes establish a hyperbolic-like electrostatic field.

15. In combination with a microwave tube, the collector which comprises:

a bounded evacuated region;

a first metal electrode having a circular-like opening for permitting passage of electrons;

a final metal electrode;

at least one metal electrode spaced intermediate said first metal electrode and said final metal electrode within said region, said electrodes defining an essentially two-dimensional geometric curve;

electron beam passages in all of said intermediate electrodes along the axis of said circular opening, said passages comprising an elongated rectangular geometry and located asymmetrically in said respective electrode;

said circular-like opening being located asymmetrically with respect to said intermediate electrodes; and means for applying distinct voltages to each of said electrodes for producing an electrostatic field, as viewed from said opening, in said evacuated region characterized by the second mathematical derivative of the voltage with respect to the length of said collector from said opening being a positive value.

* * * * *